US011209134B2

(12) United States Patent
Gielen et al.

(10) Patent No.: US 11,209,134 B2
(45) Date of Patent: Dec. 28, 2021

(54) LUMINAIRE CLOSING CONSTRUCTION BASED ON LED ASSEMBLY TIGHTENING

(71) Applicant: SIGNIFY HOLDING B.V., Eindhoven (NL)

(72) Inventors: Herman Johannes Gertrudis Gielen, Valkenswaard (NL); Vincent Stefan David Gielen, Gastel (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/966,462

(22) PCT Filed: Jan. 28, 2019

(86) PCT No.: PCT/EP2019/051977
§ 371 (c)(1),
(2) Date: Jul. 31, 2020

(87) PCT Pub. No.: WO2019/149652
PCT Pub. Date: Aug. 8, 2019

(65) Prior Publication Data

US 2021/0033250 A1 Feb. 4, 2021

(30) Foreign Application Priority Data

Feb. 5, 2018 (EP) ..... 18155031

(51) Int. Cl.
*F21S 4/28* (2016.01)
*F21S 2/00* (2016.01)
(Continued)

(52) U.S. Cl.
CPC ..... *F21S 4/28* (2016.01); *F21S 2/005* (2013.01); *F21V 19/0055* (2013.01);
(Continued)

(58) Field of Classification Search
CPC .... F21V 19/0055; F21V 19/004; F21V 23/06; F21S 4/28; F21K 9/272; F21K 9/278
See application file for complete search history.

(56) References Cited

U.S. PATENT DOCUMENTS 7,927,154 B2 4/2011 Sekela et al.
8,827,486 B2 * 9/2014 Lai ..... F21V 23/002 362/218

(Continued)

FOREIGN PATENT DOCUMENTS

CN 201487888 U 5/2010
CN 201884976 U 6/2011

(Continued)

*Primary Examiner* — William N Harris
(74) *Attorney, Agent, or Firm* — Daniel J. Piotrowski

(57) ABSTRACT

The invention provides a luminaire (200) comprising a hollow light transmissive body (210), an LED assembly (100) comprised by the hollow light transmissive body (210), and a first end cap (220) closing the hollow light transmissive body (210) at a first end (211) of the hollow light transmissive body (210) and functionally coupled to the hollow light transmissive body (210); wherein (i) the LED assembly (100) is functionally coupled to a connector part (132); (ii) the first end cap (220) is functionally coupled to a complementary connector part (222), complementary to the connector part (132); and (iii) the LED assembly (100) and the first end cap (220) are associated with each other through the connector parts (132, 222), while allowing a translational movement of the LED assembly (100) along a longitudinal axis (115) relative to the hollow light transmissive body (210).

12 Claims, 6 Drawing Sheets

(51) Int. Cl.

| | |
|---|---|
| ***F21V 19/00*** | (2006.01) |
| ***F21V 23/06*** | (2006.01) |
| ***F21V 31/00*** | (2006.01) |
| ***F21Y 103/10*** | (2016.01) |
| ***F21Y 115/10*** | (2016.01) |

(52) U.S. Cl.
CPC ..... *F21V 23/06* (2013.01); *F21V 31/005* (2013.01); *F21Y 2103/10* (2016.08); *F21Y 2115/10* (2016.08)

(56) References Cited

U.S. PATENT DOCUMENTS

| | | | | |
|---|---|---|---|---|
| 9,033,741 | B2 * | 5/2015 | Su | H01R 33/0854 439/612 |
| 9,239,136 | B1 | 1/2016 | Petersen et al. | |
| 9,625,130 | B2 | 4/2017 | Bishop | |
| 10,041,658 | B2 * | 8/2018 | Li | F21V 19/0055 |
| 2011/0117786 | A1 * | 5/2011 | Takata | F21K 9/27 439/628 |
| 2014/0286004 | A1 * | 9/2014 | Su | F21V 21/14 362/218 |
| 2015/0184838 | A1 * | 7/2015 | Li | F21V 19/003 362/217.16 |
| 2015/0260379 | A1 | 9/2015 | Li et al. | |
| 2017/0191640 | A1 * | 7/2017 | Ji | F21V 17/12 |
| 2018/0112836 | A1 * | 4/2018 | Rieder | F21K 9/272 |

FOREIGN PATENT DOCUMENTS

| | | | |
|---|---|---|---|
| CN | 203384703 | U | 1/2014 |
| CN | 204387755 | U | 6/2015 |
| EP | 2713446 | A1 | 4/2014 |
| EP | 2716958 | A1 | 4/2014 |

* cited by examiner

LUMINAIRE CLOSING CONSTRUCTION BASED ON LED ASSEMBLY TIGHTENING

CROSS-REFERENCE TO PRIOR APPLICATIONS

This application is the U.S. National Phase application under 35 U.S.C. § 371 of International Application No. PCT/EP2019/051977, filed on Jan. 28, 2019, which claims the benefit of European Patent Application No. 18155031.0, filed on Feb. 5, 2018. These applications are hereby incorporated by reference herein.

FIELD OF THE INVENTION

The invention relates to a luminaire and a LED assembly for a luminaire. The invention further relates to a mounting clip and a printed circuit board for uses in such luminaire and for a method of assembling a luminaire.

BACKGROUND OF THE INVENTION

Luminaires and LED light assemblies for a luminaire are known in the art. U.S. Pat. No. 9,625,130, for instance, describes an LED light assembly that includes a plurality of LED printed circuit boards (PCB), with each LED PCB having at least one LED bulb and electrical connector pads configured at each opposite end of the boards. A two-component surface mount electrical connector is configured to connect one end of a first LED PCB to an end of a second said LED PCB such that the first and second LED PCBs are electrically connected end-to-end. The connected LED PCBs may be configured in a light tube that includes connector end caps for mounting the light tube in a light fixture.

SUMMARY OF THE INVENTION

In the design of luminaires, for example waterproof luminaires, a construction must be made where end caps of the luminaires are mounted to the central body of the luminaire. Such a construction often uses a metal construction on which the PCB with LEDs is mounted. The metal part is also used to mount the end caps. An alternative way to close the luminaire is to add features to the central body that allows screwing the end caps. This construction requires that extruded central body parts are post treated to make this construction that allows closing the luminaire. Yet a further way to connect end caps to extruded housings is by means of split end caps, in which one part is glued to the tube and the other is mounted to the glued parts by means of screws. The last version may especially be used in serviceable luminaires where replacement of e.g. batteries is needed.

The above described ways of closing the luminaire requires the addition of a metal construction along the length of the luminaire (that can be up to 5 ft. or even more) or e.g. dedicated split end caps. In case mounting features are added to the central body of the luminaire, the extruded central body must be post treated to add the mechanical features. In case split end caps are used, dedicated end caps are required and extra workload is required for gluing one part of the end cap to the tube. In all cases, the luminaire construction is not the most cost effective.

Hence, it is an aspect of the invention to provide an alternative luminaire and a method for providing a luminaire, which preferably further at least partly obviate one or more of above-described drawbacks. It is also an aspect of the invention to provide an LED assembly for mounting in a luminaire, which preferably further at least partly obviates one or more of above-described drawbacks. Yet, in further aspects, an inventive mounting clip and an inventive printed circuit board for in a luminaire are provided.

The present invention may have as object to overcome or ameliorate at least one of the disadvantages of the prior art, or to provide a useful alternative.

Therefore, the invention provides in a first aspect a luminaire comprising a hollow light transmissive body, an LED assembly comprised by the hollow light transmissive body ("body" or "hollow body"), and a (first) end cap closing the hollow light transmissive body at a first end of the hollow light transmissive body and functionally coupled to the hollow light transmissive body; wherein the LED assembly is functionally coupled to a connector part, (wherein) the (first) end cap is functionally coupled to a complementary connector part, complementary to the connector part; wherein the LED assembly and the (first) end cap are associated with (or connected to) each other through the connector parts, while allowing a translational movement of the LED assembly along a longitudinal axis (of the luminaire) relative to the hollow light transmissive body; and wherein the luminaire comprises a resilient element arranged for forcing the LED assembly and the first end cap in a direction to each other.

The translational movement is especially a movement due to expansion. The translational movement may be over a (predetermined) translation length.

In a further aspect, the invention provides an LED assembly for mounting in a luminaire comprising a hollow light transmissive body and a (first) end cap.

In a specific embodiment, the LED assembly (for mounting in a luminaire comprising a hollow light transmissive body and a (first) end cap) is functionally coupled to a connector part, wherein the connector part is configured complementary to a complementary connector part of the first end cap for closing the hollow light transmissive body at a first end of the light transmissive hollow body; wherein (i) the LED assembly is configured for connecting to the first end cap of the luminaire through the connector parts, while allowing a translational movement of the LED assembly along a longitudinal axis of the luminaire relative to the hollow light transmissive body of the luminaire; (ii) the resilient element is coupled to the LED assembly and to the connector part; and (iii) the connector part is arranged translationally movable relative to the LED assembly for allowing the translational movement and for functionally coupling the LED assembly and the connector part.

Manufacturing of the luminaire according to the invention may be less complex than assembling prior art luminaires. The LED assembly may easily be mounted in the luminaire and the luminaire may be closed by connecting (mounting) the first end cap and optionally a second end cap to the LED assembly. The LEDs assembly itself may be used as a way to mount (one of) the end caps, so no separate metal construction or post treatment to the central (hollow light transmissive) body may be required. The two complementary connector parts may easily be associated with each other to close the luminaire. A complex LED assembly or end cap may not be required to provide these connector parts. The luminaire according to the invention may comprise less elements and/or elements that are less complex to manufacture than luminaires known in the art.

In specific embodiments, the LED assembly may comprise a mounting clip, especially a small clip that is functionally associated with a connector part and that may be clicked on a support for LEDs (comprised by the LED assembly). By successively associating the end cap with the mounting clip, the luminaire may be closed.

Manufacturing of the luminaire may require substantially no tooling. As only an adapted LED assembly is required, a cost effective and simple construction may be obtained. In specific embodiments, the LED assembly may comprise (only) a printed circuit board ("PCB") (functionally coupled to a mounting clip). Therefore, advantageously, a luminaire may be assembled from/comprising substantially only a hollow light transmissive body, a PCB, a mounting clip, and one or two end caps.

A further advantage may be the robustness of the luminaire, even while comprising delicate components. The luminaire of the invention may comprise a working line of a (especially permanent) force (tension) between the end cap and the LED assembly being exerted in a neutral plane of LED assembly, as to prevent any bending stresses that might damage the assembly, such as a PCB, and further components, e.g. LEDs. Moreover, in prior art luminaires, the LED assembly may be connected to the luminaire at only one side of the luminaire. The remainder of the LED assembly may only be supported by the luminaire, not being fixated with the other end of the body of the luminaire (including the end cap). Such LED assembly may actually partly hover in the luminaire (when being in use).

Furthermore, in prior art solutions (thermal) expansion of the body of the luminaire (when being in use) as a result of an increased temperature may be larger than the expansion of the LED assembly, providing a further separation of the LED assembly from the body. Such difference in expansion may be e.g. a few mm up to 5-10 mm when being in use (wherein (the body of) the luminaire may reach a temperature of 75-85° C.) relative to the luminaire not being in use. Additionally, small deviations (tolerances) in the length of the body may be present giving rise to a difference in length of the body relative to the length of the LED assembly. Yet, the LED assembly of the invention when mounted in the luminaire may permanently (and also releasably) be associated with the body and/or end cap(s), i.e. also when the light transmissive body expands (because of the increased temperature) in a larger amount than the LED assembly, the LED assembly may still be connected to the end cap as well as to a further location of the body of the luminaire.

Hence, in embodiments the translational movement of the LED assembly along the longitudinal axis relative to the hollow light transmissive body may especially be based on a difference in thermal expansion between the LED assembly and the hollow light transmissive body.

The luminaire, essentially, comprises the hollow light transmissive body, especially configured for enclosing or comprising (containing) a light source. The hollow light transmissive body, is especially configured for enclosing or comprising (containing) an LED assembly comprising the light source. Hence, the light transmissive body may be configured to host the LED assembly.

The hollow body may be configured for enclosing the LED assembly (for a plurality of LEDs) comprising (the) LEDs (light emitting diodes). The light source, especially the (plurality of) LEDs may emit light. Herein, light emitted by a light source, especially by one or more LEDs, may also be referred to as light source light. The term "light" especially relates to (at least part of) the light source light. Moreover, when the term "light" is used in the description and the claims, it will be clear to the skilled person when this relates to "light source light" or when this (very rarely) may relate to light in general, such as to "sun light" or light from the surrounding of the luminaire entering the luminaire.

The hollow light transmissive body described herein is essentially a body comprising a cavity. The hollow body is especially an elongated body. Also, the cavity, especially, comprises a longitudinal shape. The hollow light transmissive body is especially tubular, though the cross-sectional shape is not necessarily circular. The length of the cavity is essentially the same as the length of the body, like a TL lamp. The body may have a length of at least about 10 cm, such at least about 15 cm, like selected from the range of 10-200 cm.

The cavity (when the body is not closed) may be in open connection with the surroundings of the hollow body at two (opposite) ends (especially arranged at a longitudinal axis of the hollow body) of the hollow body (when no end cap is mounted). The cavity may also be in open connection with the surroundings at a first end and at a second end of the hollow body (when no end cap is provided to the hollow body). The hollow light transmissive body may also be configured for having a cavity that only comprises one open connection with the surroundings. The cavity at least is configured for comprising one open connection with the surroundings at the first end of the hollow body. When completely assembled the open connection(s) may be closed by (an) end cap(s).

In embodiments, the hollow body is (or may be) closed at two ends of the hollow light transmissive body, especially by a first end cap at a first end and a second end cap at a second end of the hollow light transmissive body. Alternatively, the hollow body is (or may be) only closed by the first end cap. For instance, in embodiments the hollow body may have an opening at a single extremity (which may be closed by the end cap).

It is noted that the first end cap and the optional second end cap do not need to be the identical. The first end cap is especially configured for associating with the LED assembly via the mutual connector parts, i.e. via the connector part and the complementary connector part. For this, the first end cap may be functionally coupled to the complementary connector part configured for connecting with the connector part functionally coupled to the LED assembly. The second end cap (when present) may be configured substantially identical to the first end cap, allowing it to (also) associate with the LED assembly (at another end of the assembly) via a further connector part (see below).

The luminaire may have the feature that the mounting clip is detachably connected to both the LED assembly and the first end cap. The second end cap may additionally or alternatively also be configured for directly coupling to the LED assembly (without said connector parts arranged in between). Such direct coupling may comprise a detachable coupling. Such direct coupling may e.g. comprise a snap-in coupling. Especially, such direct coupling is a fixed (and optionally detachable) coupling, especially not allowing a (translational) movement of the LED assembly relative towards (and away from) the second end cap (when mounted). The (function of the) second end cap may be integrated in the hollow body. Therefore, (alternatively) the second end of the hollow body may be configured for directly coupling to the LED assembly. Alternatively, the second end cap is in embodiments configured for direct coupling to a LED assembly. Hence, also the LED assembly may (further) be configured for direct coupling to the hollow body and/or the second end cap.

Essentially, one or two end caps are coupled to the hollow light transmissive body and especially the respective end cap completely closes the hollow light transmissive body, especially such that no water and/or dust may enter the light transmissive body. The luminaire thus may be a waterproof luminaire. The luminaire may be a luminaire according to the International Protection Marking IP65 (or higher). The luminaire may be configured for preventing ingress of dust and water. This may e.g. be provided by a tight fit of the end cap with the hollow body. Furthermore, seals may be arranged between the end cap and the hollow body. The end cap may comprise a seal. Especially, the end cap is indirectly coupled to the hollow light transmissive body. The end cap may be coupled to the hollow light transmissive body via the LED assembly or via a printed circuit board (PCB) (see below). The luminaire may be closed based on LED assembly tightening.

The term "functionally coupled" as used in the phrase "functionally coupled to the hollow light transmissive" and "the LED assembly is functionally coupled to the connector part" may thus relate to indirectly (via further elements) coupled (but yet contacting, directly or indirectly). The term may also relate to be directly coupled. The term therefore also relates (in embodiments) to comprising and including. For instance, the LED assembly may comprise the connector part. Furthermore, the term "associated with" may especially relate to "connected to". The term "end cap" may relate to one or more of the first end cap and the second end cap.

The invention is initially explained based on a first end cap only, wherein the hollow light transmissive body only requires the first end cap to be mounted to close the hollow body (i.e., the hollow body is already closed at the other end of the body, e.g. by the hollow body itself or by a second end cap). Especially, therefore in embodiments, the LED assembly, mounted in the hollow body, is associated with the hollow body at a location remote from the first end of the LED assembly, such as at the second end of the LED assembly. The LED assembly may comprise an elongated LED assembly comprising a first end of the LED assembly and a second end of the LED assembly. Both of said ends may be arranged at a longitudinal axis of the LED assembly. As discussed above, in embodiments, the second end of the LED assembly is (already) associated with the hollow body (such as via a further mutual connector part coupling (see below), or via a direct coupling to an (integrated) second end cap) and especially the second end of the hollow body is closed. The LED assembly may comprise the connector part or may be functionally coupled to the connector part at one of the ends of the LED assembly, such as at the first end of the LED assembly.

The "longitudinal axis of the luminaire", "the longitudinal axis of the LED assembly" and "the longitudinal axis of the hollow transmissive body" and also "the longitudinal axis of the mounting clip" (see below) may be arranged parallel and especially may coincide. The term "longitudinal axis" may thus relate to any (or all) of the aforementioned longitudinal axis. Furthermore, the term "axis" especially relates to a longitudinal axis.

The hollow light transmissive body is at least partly light transmissive. When light source light is generated inside the (closed) hollow light transmissive body, the light (source light) may travel from the inside of the hollow body through at least part of a wall of the hollow body to the surroundings of the luminaire. Alternatively or additionally, (only) a part of the light source light generated inside the luminaire may travel through the wall of the hollow body. For instance, the body may be configured for transmitting one or more selected colors of the light source light, or light having a specific wavelength selected from a range of wavelength of the light source light. Furthermore, the body may be configured for transmitting light source light at a specific location, such as a side of the body. The hollow body may e.g. comprise two (or more) distinct parts of the body, especially wherein one part is light transmissive and the other part(s) is (are) not light transmissive. The hollow body may e.g. comprise a face for coupling out light. The body may further comprise a non-transmissive part, e.g. for mounting the luminaire at surface, that especially does not need to be lighted, e.g. a ceiling. Hence, the entire hollow light transmissive body may be light transmissive for the light of the LED assembly. However, in other embodiments one or more parts of the light transmissive body are light transmissive ("window") and one or more other parts are not light transmissive (e.g. a back side).

Herein, the terms "hollow light transmissive body" and "hollow body" may be used interchangeably. Further, the term "body" may relate to the term "hollow light transmissive body".

The hollow body may further comprise a receiving element in the wall of body, such as a groove or a rim, for receiving at least part of the LED assembly and especially for allowing the translational movement of the LED assembly in the hollow body (including a translational movement of the hollow body relative to the LED assembly). Said receiving element is especially arranged in a direction parallel to the longitudinal axis of the hollow body. Likewise, at least part of the LED assembly may be configured for being received by the receiving element in the wall of the body and for allowing the translational movement. The LED assembly may e.g. comprise runners or sliding elements configured to run or slide in the groove. Yet, also, a perimeter of the support may be configured to slide in the receiving element of the wall.

The hollow body may comprise a body material, such as plastic, especially a light transmissive plastic, such as PC (poly carbonate) or PMMA (poly methyl methacrylate), At least part of the hollow body may be produced via extrusion. The term "body material may comprise a plurality of different body materials.

The LED assembly may directly or indirectly support (and/or comprises) the LEDs. The LED assembly may comprise a support for the plurality of LEDs. The LED assembly may comprise a support. Essentially, the support defines a base for the LEDs. The LED assembly, especially the support, may comprise a solid plate, such as a metal plate or a plastic plate. The LED assembly, especially the support, may comprise openings. The support may in embodiments comprise a plate defining a base for a flexible PCB.

In embodiments, the support comprises a gear tray, especially is a gear tray. In further embodiments, the LED assembly comprises a gear tray. Gear trays may comprise LEDs and further (especially electric) components, such as a driver, wiring, a (micro) processor, and components to control the LEDs. The LED assembly, especially the support, may alternatively or additionally comprise a printer circuit board (PCB). In a specific embodiment, the support is a PCB. The PCB may comprise the LEDs. When being mounted in the luminaire, the LED assembly may essentially not bend and/or be bent, as to prevent any bending stresses that might damage the LED assembly, especially the support and/or components, e.g. LEDs.

In embodiments, the LED assembly, especially the support, comprises one or more of (i) a printed circuit board comprising the LEDs and (ii) a gear tray comprising the LEDs, Additionally or alternative the LED assembly, especially the support, comprises a rigid (metal) plate comprising a flexible printed circuit board comprising the LEDs. In embodiments, the support comprises a printed circuit board comprising the LEDs.

The luminaire, especially the LED assembly, may comprise a resilient element. Such resilient element may allow the LED assembly (including the resilient element) to stretch, especially to compensate for a difference in expansion of the body of the luminaire and the support (when the luminaire is in use). The resilient element may especially be configured for allowing or providing the translational movement of the LED assembly. The resilient element may be configured for providing a tensile force between the support and the end cap. The resilient element may (thus) force the LED assembly and the (first) end cap towards each other.

Hence, in embodiments, the LED assembly and the (first) end cap are resiliently connected to each other. In specific embodiments, the luminaire comprises a resilient element arranged for forcing the LED assembly and the (first) end cap in a direction to each other. In further embodiments, the luminaire is configured for closing the hollow transmissive body at an end, especially the first end, with an end cap, especially the first end cap, by a permanent tensile force induced by the resilient element.

The resilient element may e.g. comprise an elastic element, e.g. comprising a (elastic) plastic, and/or a spring element, such as a spring. Essentially, the resilient element may be (elastically) stretched over a few mm up to 10 mm without breaking. Hence, a (elastic) plastic element may comprise the resilient element. Furthermore, a further spring element, such as a spring may comprise the resilient element. Examples of a spring are, e.g. a leaf spring, a coil spring, a volute spring, a tension spring, etc. The resilient element may especially comprise a leaf spring. The term "resilient element" may relate to a plurality of (different) resilient elements.

The LED assembly may comprise the connector part. Hence, the connector part may be part of the LED assembly. Yet, the connector part may also be a self-contained connector part functionally coupled to the LED assembly. Moreover, the connector part may be configured for functionally coupling to the LED assembly. The LED assembly may comprise a mounting part, especially arranged at an end of the LED assembly, especially at the first end of the LED assembly. The connector part may be functionally coupled to the mounting part. The term "the connector part of the LED assembly" and the like may therefore be used in the description in relation to the connector part functionally coupled to (the mounting part of) the LED assembly and to the connector part comprised by (the mounting part of) the LED assembly.

Likewise, the first end cap (and optionally also the second end cap) may comprise the complementary connector part. Hence, the terms "the complementary connector part of the of the first end cap" and "the complementary connector part of the of the second end cap" and the like may be used in relation to the complementary connector part being functionally coupled to the first end cap, respectively the second end cap. It may further relate to the complementary connector part being comprised by first end cap, respectively the second end cap, and.

Furthermore, the (complementary) connector part of the end cap and the connector part of the LED assembly are mutually complementary. Therefore, the term "complementary" is an adjective relating the two connector parts to each other and may not always explicitly be used in the description and/or claims referring (only) to the (complementary) connector part of the end cap. Especially, when it is clear from the description, the term "complementary" may be omitted. For instance, the phrases "the connector part of the (first) end cap" or "functionally coupling the connector part to the (first) end cap" especially relate to the connector part of (the first) end cap being complementary to the connector part of the LED assembly.

Essentially, the connector part of the LED assembly and the connector part of the end cap are configured for forming a mutual connection, also described herein as a "mutual connector part coupling". The two connector parts may be configured together defining a male-female connection or a complementary connection. Examples of such complementary connector parts e.g. comprise a pin and a hole, a plug and a socket, a hook and an opening, a protrusion and an opening, an internal screw thread and an external screw thread, a bolt and a nut, a screw and a hole, etc. The connector parts, forming the mutual connector part coupling, are especially arranged in the luminaire for allowing a translational movement of the LED assembly along the longitudinal axis of the luminaire relative to the hollow light transmissive body. The connector parts may be configured for mutually connecting to each other, wherein a force exerted on the LED assembly, especially the support is configured in a direction along the longitudinal axis of the LED assembly, especially for preventing the LED assembly (support) to bend during attaching the end cap to the support (see also above). For instance, when using connector parts comprising mutually complementary screw thread, an axis of the screw thread may be configured parallel to the longitudinal axis of the LED assembly. The longitudinal axis of the LED assembly may be configured parallel to the longitudinal axis of the luminaire.

Hence, in embodiments, the connector part comprises (a nut comprising) screw thread and the complementary connector part comprises (a bolt comprising) a complementary screw thread, complementary to the screw thread (of the connector part). Especially, wherein an axis of the screw thread is configured parallel to a longitudinal axis of the LED assembly. The nut especially comprises a hex nut. Yet, the nut may also comprise other types of nuts.

The term "translational movement" in phrases like "translational movement relative to the hollow light transmissive body", relates to a movement of at least part of the LED assembly, especially induced by the difference in expansion relative to the hollow light transmissive body. Hence, the translational movement is an expansion (movement). In embodiments, a part of the LED assembly is fixated to the hollow light transmissive body. Such part (such as the second end of the LED assembly) may not move relative to the hollow light transmissive body. Yet, a part of the LED transmissive body, especially a part that is not directly fixated to the hollow light transmissive body, may move in a longitudinal direction with respect to the hollow body, especially when the hollow body expands relative to the LED assembly. A (determined) location at the LED assembly may translate along the longitudinal axis relative to a (determined) location of the hollow light transmissive body. Especially, the first end (and optionally the second end) of the LED assembly may translate along said longitudinal axis relative to an end of the hollow light transmissive body. The translational movement may be over the (predetermined) translation length. The translational movement is especially based on a difference in thermal expansion (coefficients) between the hollow light transmissive body and at least part of the LED assembly and may be induced by heat generated in the luminaire when being used. The translation length may thus especially be the expansion length. The translation length may thus depend upon the material of the hollow body and of the LED assembly, and on the temperature the materials experience. Instead of the term "translation length", also the term "translational length" may be applied.

For allowing such translation, the LED assembly may (detachably) comprise or enclose the connector part. Furthermore, the (first) end cap may functionally be coupled to the (complementary) connector part. The (first) end cap may e.g. comprise a complementary connector part receiving element enclosing, especially fixedly (and detachably) comprising, at least part of the complementary connector part. Said receiving element may be configured for allowing the complementary connector part to translate along the longitudinal direction of the luminaire (when mounted in the luminaire) in the receiving element, especially over the (predetermined) translation length. Further, the resilient element may be coupled to the first end cap and to the complementary connector part, especially for providing a permanent tensile force between the LED assembly (the support) and the end cap. This way the complementary connector part may translate in the complementary part receiving element while exerting a tension force on the LED assembly (via the resilient element). In particular the resilient element is configured to exert a permanent force in axial direction along the longitudinal axis when the connector part is connected to the complementary connector part.

Hence, in embodiments, the resilient element is coupled to the (first) end cap and to the complementary connector part, and the complementary connector part is arranged translationally movable relative to the (first) end cap. In further embodiments, the first end cap comprises a complementary connector part receiving element and wherein the complementary connector part is arranged translationally movable (relative to the LED assembly) in the complementary connector part receiving element.

Alternatively the connector part of the LED assembly may be configured translationally movable in the LED assembly, especially in the mounting part. In such embodiment, the LED assembly may be functionally coupled to the connector part. Especially in such embodiment, the resilient element may be associated with (the mounting part of) the LED assembly and with the connector part. Such embodiment may advantageously be combined with an embodiment wherein the end cap comprises, especially fixedly (and detachably, at least part of the complementary connector part.

Hence, in further embodiments, the resilient element is coupled to the LED assembly, especially to the mounting part, and to the connector part, and the connector part is arranged translationally movable relative to (the remainder of) the LED assembly. In further embodiments, the LED assembly, especially the mounting part, comprises a connector part receiving element and the connector part is arranged translationally movable (relative to the LED assembly) in the connector part receiving element.

The term "end cap" may relate to one or two end caps. The term may especially relate to the first end cap and/or the second end cap.

The connector part may be incorporated in at least one of the first and second ends of the LED assembly. The LED assembly may comprise a first and a second mounting part, arranged at the first and respectively the second end of the LED assembly. Hence, the connector part may be incorporated in at least one of the first and second mounting parts. For instance, the support may (detachable) comprise the connector element, especially at one of the ends of the support. In embodiments, the connector part receiving element is included in the support comprises. In further embodiments, the connector part is part of the support. Hence, the support may be configured for coupling with the (complementary) connector part of the end cap. Yet, in further embodiments, a further element may be connected to the support, especially at one of the end of the support. Such further element may then be used to provide the functional coupling with the end cap. Such further element may be configured for coupling with the (complementary) connector part of the end cap. Especially, the (first and/or second) mounting part may comprise such further element.

The further element may comprise a mounting clip configured to connect to the support. In embodiments, the further element is the mounting clip. The further element may be configured to mount the end cap to the other parts of the LED assembly (especially in combination defining the LED assembly). The mounting clip may comprise the connector part. The mounting clip may be functionally coupled to the connector part. The mounting part may comprise the mounting clip.

The mounting part especially comprises an end part of the LED assembly. The mounting part may comprise a mounting clip. In other embodiments, the mounting part may comprise a part of the support. The mounting part may further comprise a part (an end part) of a gear tray. The mounting part may also comprise a part (an end part) of a PCB described herein.

Hence, in a further aspect, the invention provides a mounting clip, especially for coupling to a support of an LED assembly wherein the support comprises a complementary clip connector element. In a specific embodiment, the mounting clip comprises a clip connector element configured complementary to the complementary clip connector element of the support (of the LED assembly) for connecting the mounting clip and a support (of the LED assembly) to each other through the clip connectors. The mounting clip may be functionally coupled to a connector part and especially (the mounting clip) comprises a resilient element, wherein the resilient element is coupled to the mounting clip and to the connector part. Especially, the connector part is arranged translationally movable relative to the mounting clip.

In a specific embodiment, the clip connector element of the mounting clip and the (complementary) clip connector element of the support are connection elements configured for forming a complementary connection (also see above).

Hence, the support may comprise a complementary clip connector element. The mounting clip may e.g. comprise a clip connector element comprising a protrusion, and the support may comprise a complementary clip connector element comprising an opening configured to receive the protrusion. The opening may especially comprise a through hole. The support, essentially, comprises a (complementary) clip connector element for associating with the clip connector element the mounting clip. The complementary clip connector element and the clip connector element are essentially configured mutually complementary. Therefore, term "complementary" may not always be used in the description and/or claims referring to the (complementary) clip connector element as explained above in relation to the complementary connector part. The mounting clip and the support may be configured for connecting to each other through the clip connector elements.

The mounting clip may at least partly be flexible/resilient. The clip connector element may e.g. comprise a flexible protrusion especially allowing it to connect with a complementary clip connector element of the support. The complementary clip connector element may comprise the opening comprising an opening cross section. A cross section of the clip connector element may be configured identical or especially a few percent larger than the opening cross-section. When connecting such clip connector elements, they may have a negative clearance and provide a snap-fit connection. The connection between the clip connector elements may therefore comprise an interference fit connection. The clip connector elements are especially interlocking components together. The mounting clip may especially comprise a (elastic) plastic. Examples of such plastics are PBT (polybutylene terephthalate), or PA (polyamide, nylon).

Hence, in a further embodiment, the LED assembly comprises a support for a plurality of LEDs and a mounting clip, wherein the mounting clip is functionally coupled to the connector part. Especially, the mounting clip further comprises a clip connector element and the support comprises a complementary clip connector element (configured) complementary to the clip connector element, wherein the mounting clip and the support are connected to each other through the clip connector elements.

In further embodiments, the complementary clip connector element comprises an opening, and the clip connector element comprises a protrusion configured for arranging in the opening, especially for providing a snap-fit between the protrusion and the opening.

In specific embodiments, the clip connector elements provide an interference fit between the mounting clip and the support.

The support may have a first side configured for, or comprising, the LEDs. The opposite side of this first side may herein be referred to as the back side of the support. The mounting clip may be mounted at the support at one or more of the first side and the back side. The mounting clip may comprise a base part especially for arranging in contact with one of the sides of the support and especially comprising the clip connector element. The base part may comprise a flat part. The clip base part may have a plane arranged parallel to a base plane of the support.

In embodiments, the mounting clip comprises a clip base part and a second clip part extending from the base part. The second clip part may comprise a (top) protrusion for holding or aligning the support. The second clip part may (also) comprise other (holding) elements for holding the support. The mounting clip may especially be configured for holding the support between the clip base part and the top protrusion or other holding elements.

Hence, in embodiments, the mounting clip comprises a clip base part and a second clip part extending form the base part, wherein the base part comprises the clip connector element and the second clip part comprises a top protrusion, wherein the mounting clip is configured for holding the support between the clip base part and the top protrusion. In embodiments, the mounting clip may further be connected to the support. The support may be fitted between multiple clip parts of the mounting clip. In embodiments, the support is arranged between one or more further (top) protrusions of the mounting clip arranged at one of the sides of the mounting clip and a base part of the mounting clip comprising the clip connector element at the other side of the support. In embodiments, the mounting clip further comprises a second clip part extending from the base plane and comprising a top protrusion, especially protruding parallel to the first clip base part. The mounting clip may thus be configured for holding the support between the clip base part and the top protrusion. A protrusion may comprise a plurality of protrusions. The top protrusion may comprise a rim. The top protrusion especially extends (from the second clip part) in a direction of the support (or configured for coupling to the support). Alternatively or additionally, the second clip part comprises a groove especially configured for receiving the support. Hence, the mounting clip may (also) be configured for holding the support in the groove, especially wherein the mounting clip elements of the mounting clip and of the support are (also) mutually coupled.

Hence, in embodiments the mounting clip comprises a clip base part having a plane arranged parallel to a base plane of the support, and a second clip part extending from the base plane; wherein the base part comprises the clip connector element and the second clip part comprises a top protrusion extending from the second clip part (especially parallel to the first clip base part). The mounting clip may especially be configured for holding the support between the clip base part and the top protrusion.

The mounting clip especially comprises a longitudinal axis configured to be arranged parallel to the longitudinal axis of the support. When being connected to the support, a part of the clip base part may be arranged parallel to the support, and especially a further part of the clip base part extends in a direction away from the support (along the longitudinal axis of the LED assembly).

The mounting clip may further be configured for holding the resilient element. The mounting clip may comprise the resilient element (when associated with the support, and/or when the assembly is mounted in the luminaire). In embodiments, the resilient element is arranged at (and fixedly connected to) the clip base part, especially at a side remote from the support. The mounting clip may comprise a resilient element receiving element (i.e. a receiving element for the resilient element) configured to receive the resilient element, especially to associate the resilient element with the mounting clip. At least a part of the mounting clip, such as the resilient element receiving element, may comprise a fiber-reinforced plastic configured to hold the resilient element. In embodiments, the mounting clip comprises or holds a leaf spring, especially in the resilient element receiving element.

The mounting clip may further comprise the connector part receiving element. In a specific embodiment, the second clip part is configured to comprise at least part of the connector part. For instance, the second clip part may comprise a cavity for detachably arranging at least part of the connector part in the opening. In embodiments, the mounting clip comprises the connector part receiving element. In a further embodiment, a nut is detachably arranged in the mounting clip, especially such that the nut may translate along the longitudinal direction of the mounting clip. In a specific embodiment, the mounting clip comprises at least part of the connector part receiving element and the resilient element, especially a leaf spring, wherein the connector part receiving element comprises the connector part and especially wherein the connector part is translationally mobile (over the predetermined translation length) in a direction along the longitudinal axis of the mounting clip arranged. Furthermore, especially by connecting the complementary connector part with the connector part of an end cap, the resilient element is coupled to the connector part.

As discussed above, the luminaire may be closed at a first end with the (first) end cap and in embodiments also at a second end with the (second) end cap. Hence, also the mounting clip may be configured for arranging at the first end of the support and also at the second end of the support. In embodiments, the luminaire may comprise two mounting clips arranged at opposite ends of the luminaire, wherein each of the mounting clips is connected at the support (or a respective support, see below) at one of the respective ends of the LED assembly and wherein the connector parts of the mounting clips are connected to one of the complementary connector parts of the first end cap and the second end cap respectively.

Hence, in embodiments, the luminaire may further comprise a second end cap for closing the hollow light transmissive body at a second end of the light transmissive body, wherein the LED assembly further comprises a further mounting clip, wherein the support comprises a further complementary clip connector element, wherein each of the complementary clip connector elements are arranged at opposite ends of the support, and wherein the support is connected at both ends of the support with a respective mounting clip through the respective clip connector elements, and wherein the LED assembly and the second end cap are connected to each other through the connector parts of the second end cap and the further mounting clip respectively. The clip connector elements described herein may further relate to a plurality of clip connector elements (configured for providing a mutual connection). Also such second end cap and the LED assembly may be functionally coupled allowing a translational movement, such as via a resilient element, such as also described in relation to the coupling of the first end cap and the LED assembly.

In yet further embodiments, the LED assembly comprises a plurality of supports, wherein the adjacent supports are coupled to each other with coupling mounting clips. Such embodiments may advantageously be applied if relatively long luminaires are required, especially luminaires having a length larger than about 5 ft. or 1.50 m.

Hence, in embodiments the LED assembly comprises a plurality of supports, wherein each of the supports comprises a further complementary clip connector element), wherein each of the complementary clip connector elements are arranged at opposite ends of the support; wherein the LED assembly further comprises one or more coupling mounting clips, wherein each coupling mounting clip comprises a pair of clip connectors configured complementary to the complementary clip connector element; wherein each of the coupling mounting clips is connected to two supports through one of the clip connectors and one of the complementary clip connector elements, especially wherein the supports are arranged in line. Especially, the clip connectors and the clip connector elements are configured alike. In specific embodiments, the coupling mounting clip comprises, especially is a mounting clip.

The support described herein especially comprises one or more complementary clip elements configured for connecting to the mounting clip. In an advantageous embodiment, the support is a printed circuit board (PCB). Hence, in a further aspect the invention provides a PCB comprising a complementary clip connector element configured for connecting to a mounting clip described herein, wherein the complementary clip connector element is configured complementary to the clip connector element of the mounting clip.

As indicated above, the LED assembly may be functionally coupled to the connector part. In specific embodiments, this may imply that the LED assembly also comprises the connector part, such as the LED assembly comprising the support and the connector part, wherein the support and the connector part are functionally coupled, such as associated to each other.

In yet a further aspect, the invention also provides a method of assembling a luminaire. The method may especially comprise: providing (i) a hollow light transmissive body having an open first end (and optionally a (open) second end), (ii) an LED assembly comprising a first end (and a second end), wherein the first end is functionally coupled to a connector part on a mounting clip, and (iii) a first end cap (and optionally a second end cap), wherein the first end cap comprises a complementary connector part, configured complementary to the connector part; and arranging the LED assembly in the hollow light transmissive body and closing and functionally coupling the hollow light transmissive body at the first end with the first end cap (and optionally at the second end with the second end cap), through the respective connector parts, and activating the functionally coupling by building up a permanent tensile force in an axial direction along a longitudinal axis of a resilient element coupled to the mounting clip and to the connector part. As the combination of the hollow light transmissive body and LED assembly may also be provided as such, in yet a further aspect the invention also provides a method which comprises: providing (i) a hollow light transmissive body having an open first end, (ii) an LED assembly comprising a first end, wherein the first end is functionally coupled to a connector part, and (iii) a first end cap, wherein the first end cap comprises a complementary connector part, configured complementary to the connector part, wherein the LED assembly is comprised by the hollow light transmissive body; and closing and functionally coupling the hollow light transmissive body at the first end with the first end cap, through the respective connector parts.

Especially, closing and functionally coupling the hollow light transmissive body at the first end with the first end cap comprises forming the mutual connector part coupling.

In embodiments, the hollow light transmissive body further comprises a (open) second end. In embodiments, the second end is closed by the second end cap. The LED assembly may further comprise a second end comprising a connector part. Especially, the second end cap may comprise a complementary connector part. Yet, in embodiments, the second end of the LED assembly is configured for a direct coupling to an end cap. Furthermore, the second end cap may be configured for a direct coupling with the LED assembly. Hence, in further embodiments, closing and functionally coupling the hollow light transmissive body at the second end with the second end cap may comprise providing the mutual connector part coupling. Closing and functionally coupling the hollow light transmissive body at the second end with the second end cap may also comprise providing the direct coupling.

Especially advantageous embodiments of the device comprise options as described above.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily on scale.

DETAILED DESCRIPTION OF THE EMBODIMENTS

Figure 1:
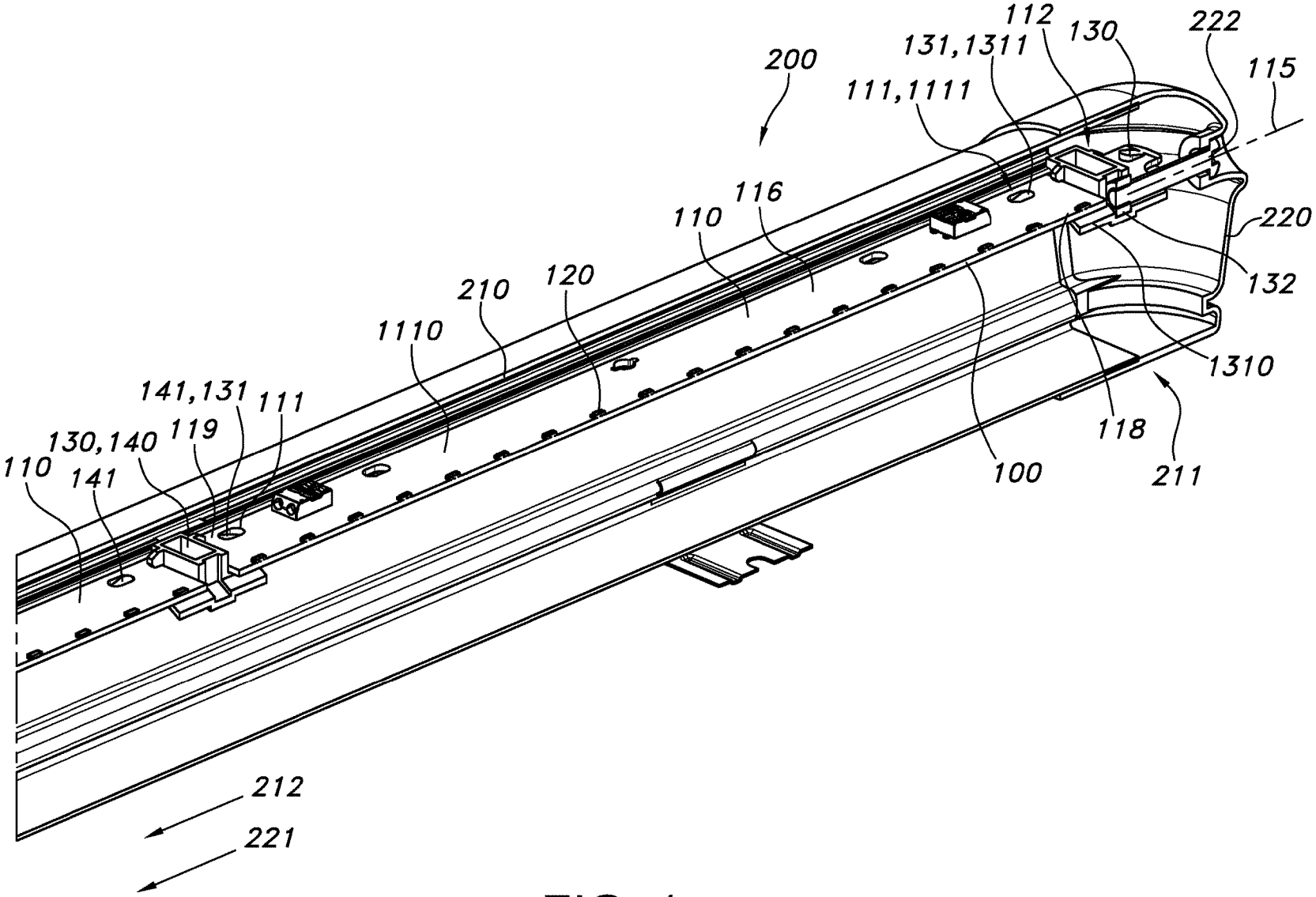
FIG. 1 schematically depicts an embodiment of the devices according to the invention.

In FIG. 1, a part of the luminaire 200 according to the invention is depicted. The luminaire 200 comprises a hollow light transmissive body 210, an LED assembly 100 and a first end cap 220 closing the hollow light transmissive body 210 at the first end 211 of the hollow light transmissive body 210. The luminaire 200 may further comprise a second end cap 212 arranged at the second end 221 of the hollow body 210 as is schematically indicated by the arrows at the left hand side of the figure. The first end cap 220 and the hollow body 210 are coupled to each other via the LED assembly 100, especially via a mutually connector part coupling provided by the connector part 132 of the LED assembly 100 and the complementary connector part 222 of the first end cap 220 (i.e. complementary to the connector part 132 of the LED assembly 100). The first end cap 220 and the hollow body 210 are especially functionally coupled via the connector parts 132,222

The LED assembly 100 comprises the connector part 132. The first end cap 220 comprises the complementary connector part 222. More specifically, in the embodiment the LED assembly 100 comprises a support 110 comprising plurality of LEDs 120. The LED assembly further comprises the mounting clip 130. The mounting clip 130 and the support 110 are connected to each other through the clip connector element 131 comprised by the mounting clip 130 and the (complementary) clip connector element 111 comprised by the support 110. The support 110 comprises a (complementary) clip connector element at the first end 118 and at the second end 199 of the support 110.

The LED assembly 100 comprises a mounting part 112, that is especially configured for mounting the end cap 220 to the hollow body 210. The mounting part 112 comprises an end of the LED assembly 110. In the embodiment, the mounting part 112 comprises the mounting clip 130 comprising the connector part 132 (or being functionally coupled to the connector part 132). In further embodiments, see e.g. FIG. 2, the mounting part 112 does not comprise a mounting clip 130, and comprises the end of the LED assembly comprising the connector part 132 (or being functionally coupled to the connector part 132).

FIG. 1 further depicts a coupling clip 140, coupling the support 110 with a further support 110. The coupling is provided by coupling of the clip connector 141 with the complementary clip connector element 111 of the supports 110. The clip connector 141 may thus be configured like the clip connector element 131. In specific embodiments, the coupling clip 140 comprises (and embodiment of) the mounting clip 130.

Figure 2B:
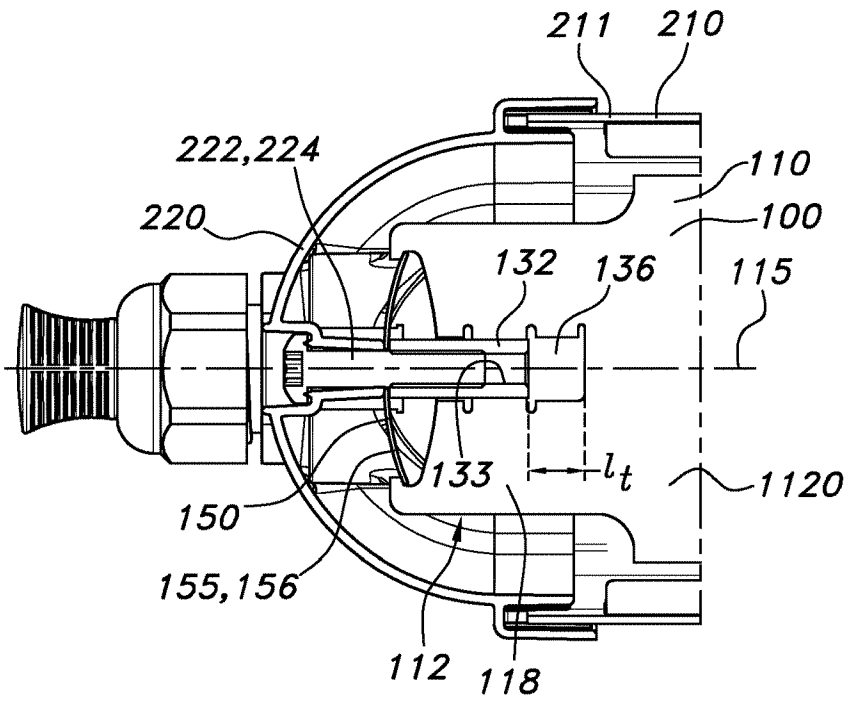
FIGS. 2-3 schematically depicts some aspects of devices according to the invention, FIG. 4 schematically depicts aspects of the mounting clip according to the invention, and FIGS. 5 and 6 schematically depict some further aspects of the invention.
Figure 2A:
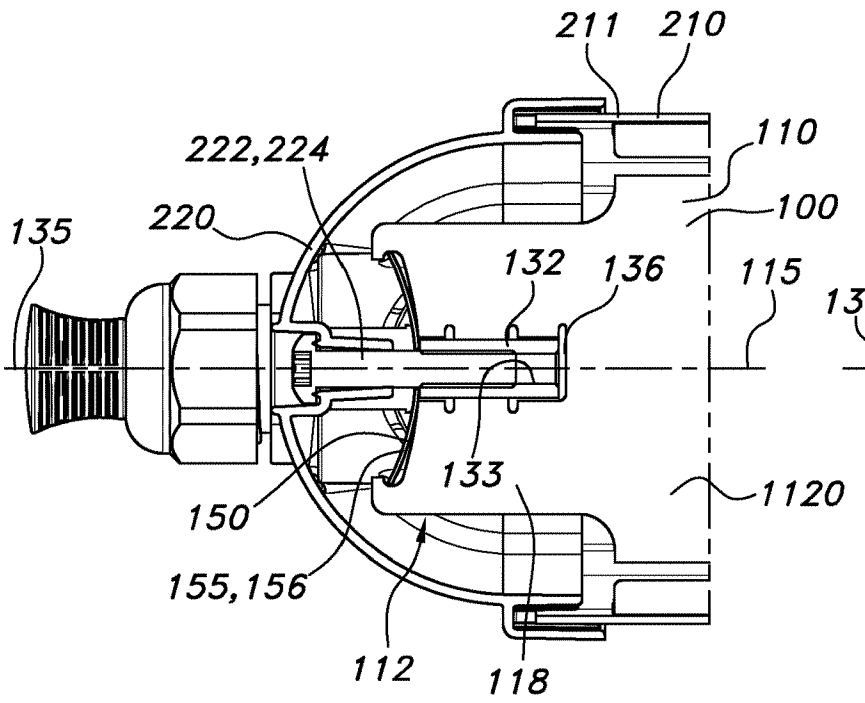
Figure 2D:
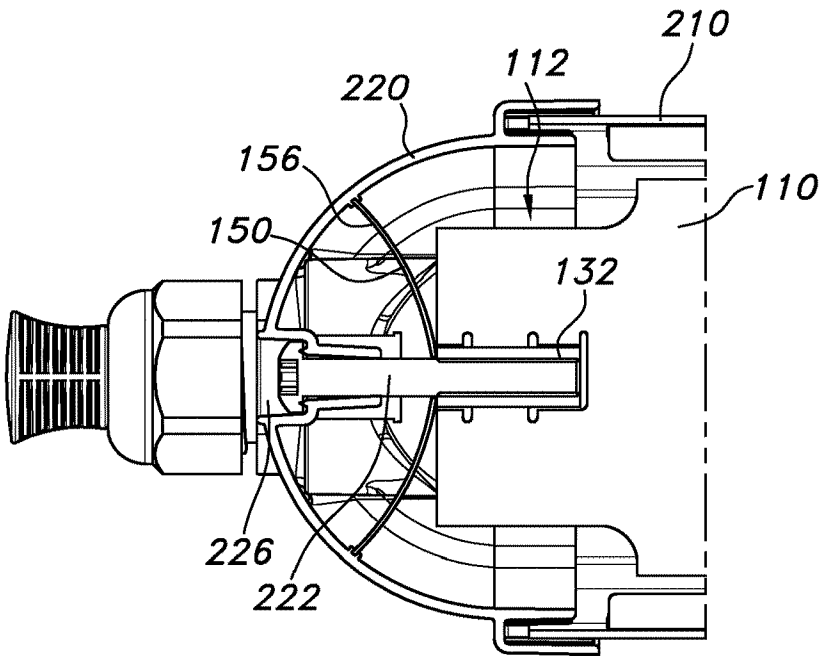
Figure 2C:
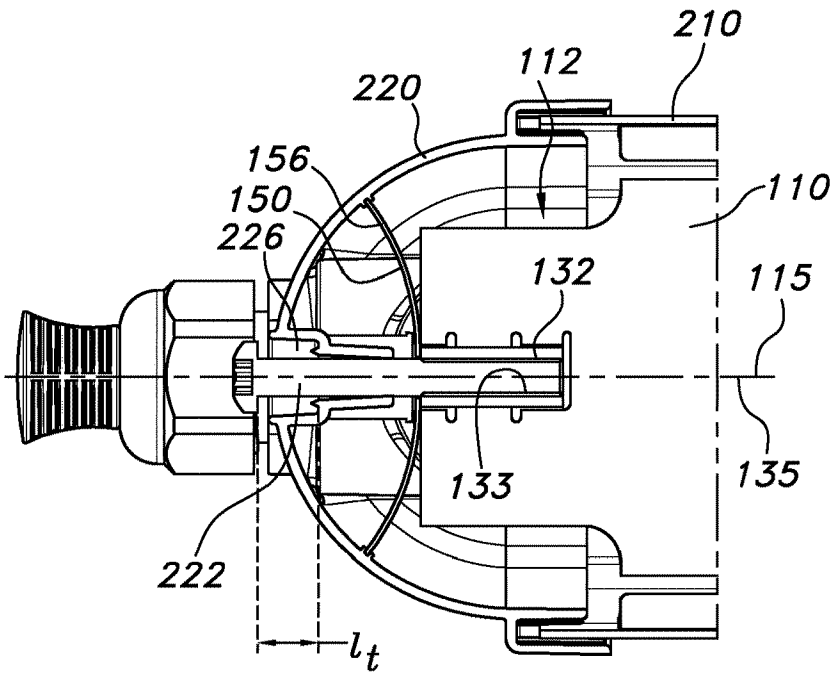
Figure 3:
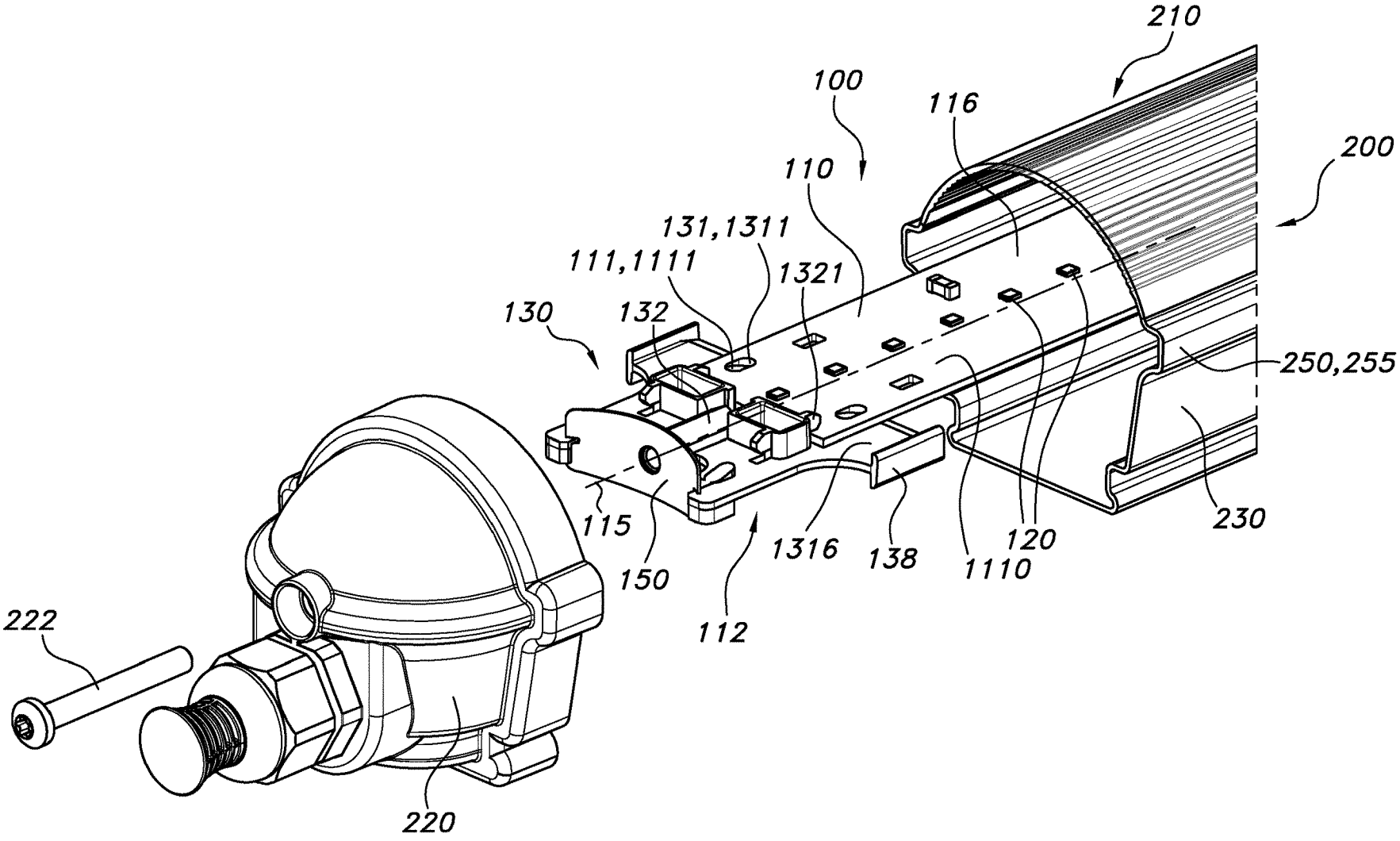

FIGS. 2-3 schematically depict in more detail aspects of the translational movement and embodiments wherein the LED assembly 100 and the first end cap 220 are resiliently connected to each other. FIGS. 2A and 2B schematically depict the same embodiment. In FIG. 2B, the hollow body 210 is expanded to a larger extend than the LED assembly 100 relative to FIG. 2A. FIG. 2A may e.g. relate to a cold luminaire 200, whereas FIG. 2B may relate to the luminaire 200 in use (thus heated up). In the figure, the LED assembly 100 and the first end cap 220 are associated with each other through the connector parts 132, 222. The first end cap 220 comprises the complementary connector part 222, especially a bolt 224. The LED assembly 100 is functionally coupled to the connector part 132 via the connector part receiving element 136 comprised by (the mounting part 112 of) the LED assembly 110. The connector part receiving element 136 comprising a part of the connector part 132, especially a nut 134 comprising screw thread 133. The nut 134 may translate in the connector part receiving element 136 over the (predetermined) translation length lt. The connector part receiving element 136 is especially configured in the mounting part 112. As is shown in the figures, only part of the LED assembly 100 and the hollow body 200 may translate relatively to each other. Especially, the first end 118 of the support 110 (of the LED assembly 100) may have made a translational movement along the longitudinal axis 115 relative to (especially the first end 211 of) the hollow light transmissive body 210. Because the resilient element 150, in the embodiment a spring element 155, embodied by a leaf spring 156, is coupled to (the mounting part 112 of) the LED assembly 100 and to the connector part 132, and the connector element 132 being mobile in the receiving element 136, the difference in expansion results in a translation of the connector part 132 and bending of the leaf spring 156, especially thereby loading the spring with extra potential energy. The loaded spring 156, successively will provide a force upon the end cap 220 in a direction of the support 110 and upon the support 110 into a direction of the end cap 220. Hence, when the difference in expansion reduces again, the spring will force the LED assembly 100 and the first end cap 220 in a direction to each other. FIGS. 2A and 2B schematically depict an embodiment wherein the connector part 132 is arranged translationally movable relative to the LED assembly 100, especially in the mounting part 112 and relative to the remainder of the LED assembly 100, such as relative to the support 110. FIG. 2B further schematically depicts that the connector part 132 comprises screw thread 133 having an axis 135 of the screw thread 133 parallel to the longitudinal axis 115.

FIGS. 2C and 2D schematically depicts a further embodiment, wherein the resilient element 150 is coupled to the first end cap 220 and to the complementary connector part 222. In that embodiment, the connector part 132 is arranged translationally movable relative to the first end cap 220. The LED assembly 100, especially the mounting part 112, comprises the connector part 132, especially (fixedly) encloses the connector part 132. The first end cap 220 comprises a complementary connector part receiving element 226 comprising a part of the complementary connector part 222. Therefore, it is also named herein that the end cap 220 is functionally coupled to the complementary connector part 222. In this embodiment, the complementary connector part receiving element 226 allows the translational movement. Now especially the complementary connector part 222 translates relative to the hollow body 210 and relatively to the end cap 220. In the embodiment, the resilient element comprises a leaf spring 156. The leaf spring 156 provides a tension between the end cap 220 and the LED assembly 110 in both figures. As a result of expansion of the hollow body 210 in FIG. 2D, the complementary connector part 220 is translated over the translation length It and a further tension is built up in the leaf spring 156. When the hollow body 210 contracts again, the increased tension will mutually pull the end cap 220 and the LED assembly (again) towards each other, and the complementary connector part 220 will translate again in the complementary connector part receiving element 226.

The LED assembly 100 in the embodiments depicted in FIGS. 2A-2D comprise a gear tray 1120.

FIG. 3 schematically depicts an embodiment wherein the LED assembly 100 comprises a support 110 and a mounting clip 130 connected to the support 110 via the connector elements 111, 131. In embodiments comprising a mounting clip 130, the mounting part 112 especially comprises the mounting clip 130. In the embodiment, the complementary clip connector element 111 comprises an opening 1111. The clip connector element 131 comprises a protrusion 1311 arranged in the opening 1111. The hollow body 210 further comprises a receiving element 250 in the wall 230 of body 210, especially a groove 255 configured for receiving the LED assembly 100 and especially allowing the translational movement of the LED assembly 100 in the hollow body 210. In the depicted embodiment, the LED assembly 100, especially the mounting clip 130 comprises wings 138, and the receiving element 250 is configured for receiving these wings 138. In other embodiments, e.g. comprising a gear tray 1120, the gear tray 1120 may be configured for sliding in the receiving element 250. The support 110 comprises a printed circuit board (PCB) 1110 that comprises the LEDs 120. The PCB 1110 comprises a complementary clip connector element 111 configured for connecting to the mounting clip 130, and configured complementary to the clip connector element 131 of the mounting clip 130.

Figure 4:
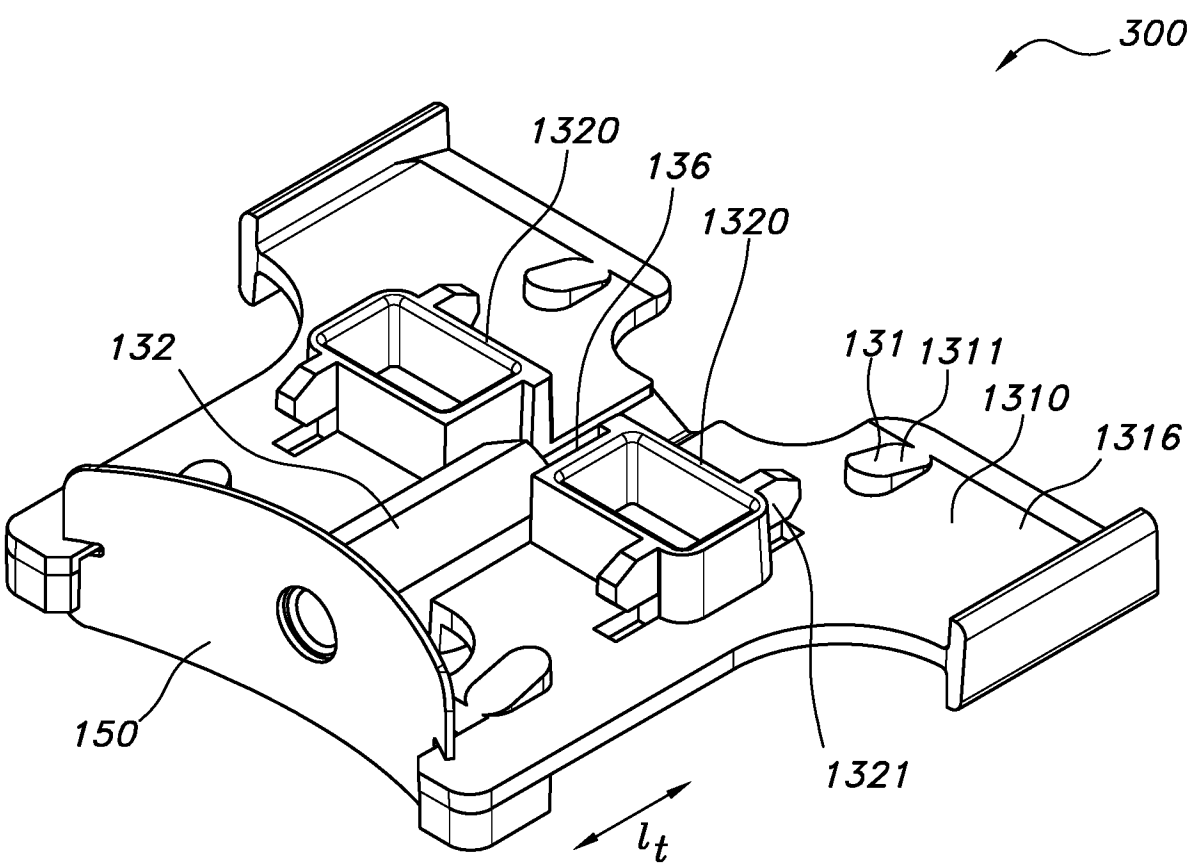

In FIG. 4, an embodiment of the mounting clip 130 is depicted in more detail, showing e.g. the clip connectors 131 embodied by protrusions 1311 and located at the base part 1310 of the clip connector 130. Especially, a combination of such protrusion 1311 and an opening 1111 having a cross-section that is a few percent smaller (such as at maximum 10% smaller) than the cross-section of the protrusion may provide an interference fit (or snap-fit) between the mounting clip 130 and the support 110. The clip base part 1310 has a plane 1316. The plane is especially configured parallel to a base plane 116 of the support 110, see also FIG. 3. The mounting clip 130 further comprises a second clip part 1320 extending from the base part 1310. The second clip part 1320 further comprises two top protrusions 1321 that protrude parallel to the clip base part 1310. In this way the mounting clip 130 may hold the support 110 between the clip base part 1310 and the top protrusion 1321, see FIG. 3. The mounting clip of FIG. 4 further is functionally coupled to the connector part 132 that may translate over a translation length lt. The mounting clip 130 also comprises the resilient element 150.

Figure 5B:
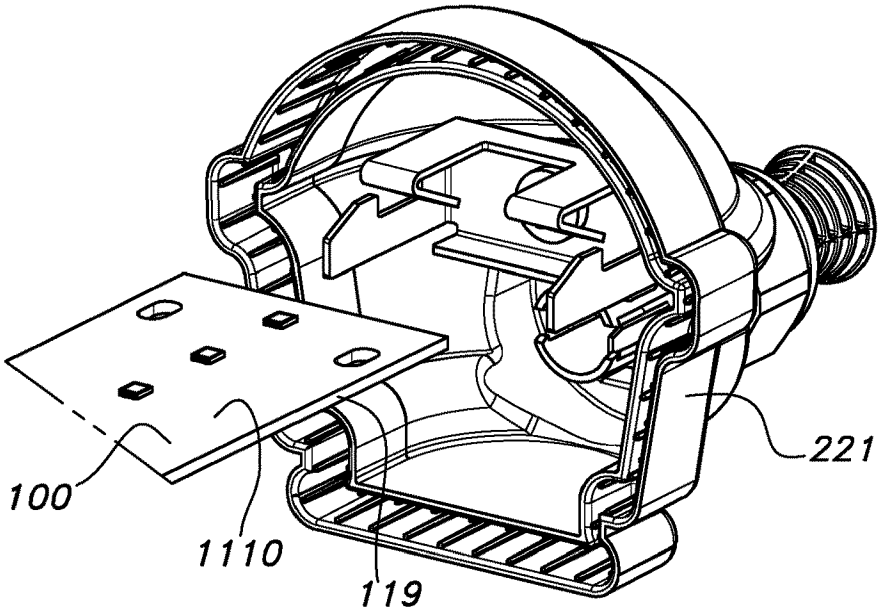
Figure 5A:
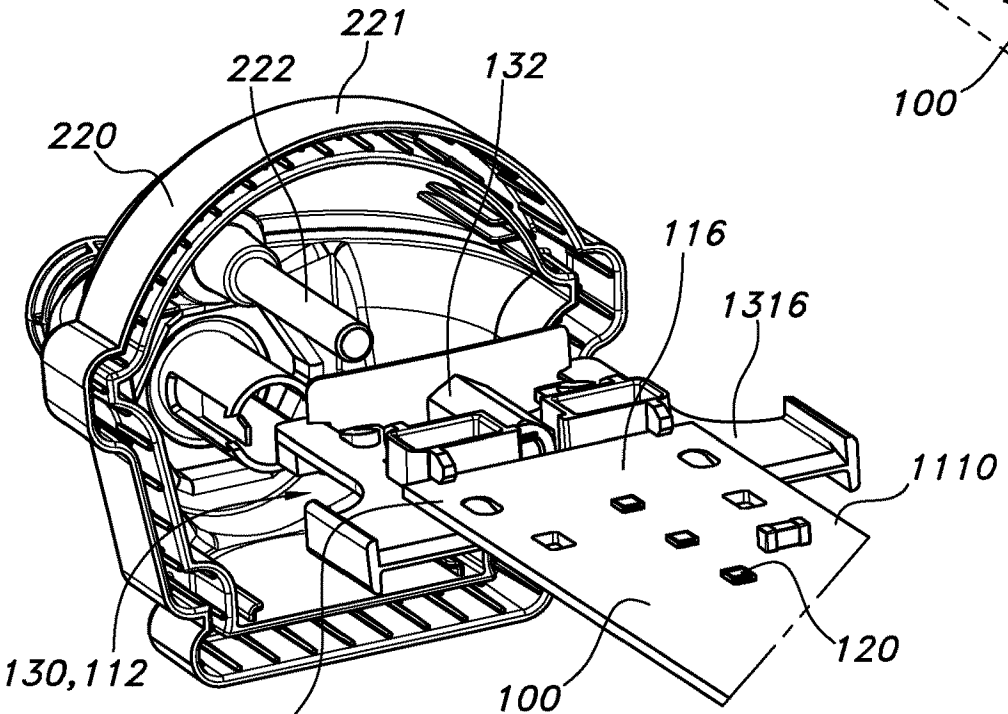

In FIG. 5A, a further embodiment of the LED assembly 100 with a (first and/or second) end cap 220,221 is depicted. The LED assembly 100 in the embodiment comprises a PCB 1110. FIG. 5B, schematically depicts an LED assembly 100 and a second end cap 221, wherein the second end 119 of the LED assembly 100 does not comprise the mounting part 112, or especially a connector part 132, and also the second end cap 221 does not comprise the complementary connector part 222. The second end cap may still be connected with the LED assembly 100 by clicking the LED assembly 100 in the second end cap 221 (or vice versa). In the depicted embodiment, the second end cap 221 is configured for receiving the second end 119 of the LED assembly 100 by means of a snap-in coupling. Therefore, the second end cap 221 comprises a snap-in element for fixedly coupling to the second end 119 of the LED assembly 100. Especially, after connecting these two parts 221,119 a connection may be formed that is referred to herein as a "direct coupling". In contrast, the connection provided by the first end cap 220 and the LED assembly 100 depicted in FIG. 5A may be named a "mutual connector part coupling" herein. The LED assembly 100 in FIG. 5B comprises a PCB 1110. In further embodiments, the second end cap 221 (and also a gear tray 1120) may be configured for coupling to the end of the gear tray 1120.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in embodiments refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. The devices described may comprise further devices according to the invention that are (already) assembled or functionally coupled to each other. As will be clear to the person skilled in the art, the invention is not limited to methods of operation, devices in operation or devices (functionally) coupled to each other.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The lighting device may be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, (outdoor) road lighting systems, urban lighting systems, green house lighting systems, horticulture lighting, or LCD backlighting.

As indicated above, the lighting unit may be used as backlighting unit in an LCD display device. Hence, the invention provides also a LCD display device comprising the lighting unit as defined herein, configured as backlighting unit. The invention also provides in a further aspect a liquid crystal display device comprising a back lighting unit, wherein the back lighting unit comprises one or more lighting devices as defined herein.

Herein the invention is explained for a support for a light source light comprising LEDs. Yet, also other types of light sources may be applied. Hence, the term "LED" and "LEDs" may also be substituted by the term "light source"

The term "light source" may also relate to a plurality of light sources, such as 2-20 (solid state) LED light sources. Hence, the term LED may also refer to a plurality of LEDs.

The invention claimed is:

1. A luminaire comprising a hollow light transmissive body, an LED assembly comprised by the hollow light transmissive body, and a first end cap closing the hollow light transmissive body at a first end of the hollow light transmissive body and functionally coupled to the hollow light transmissive body; wherein the LED assembly is functionally coupled to a connector part;

the first end cap is functionally coupled to a complementary connector part, complementary to the connector part; and the LED assembly and the first end cap are associated with each other through the connector parts, while allowing a translational movement of the LED assembly along a longitudinal axis relative to the hollow light transmissive body, wherein the luminaire comprises a resilient element arranged for forcing the LED assembly and the first end cap in a direction to each other, and wherein the resilient element is coupled to the LED assembly and to the connector part, and wherein the connector part is arranged translationally movable relative to the LED assembly;

wherein the resilient element comprises a spring element, wherein the connector part comprises a screw thread, wherein the complementary connector part comprises a complementary screw thread, complementary to the screw thread of the connector part, wherein an axis of the screw thread is configured parallel to the longitudinal axis, and wherein the translational movement of the LED assembly along the longitudinal axis relative to the hollow light transmissive body is based on a difference in thermal expansion between the LED assembly and the hollow light transmissive body.

2. The luminaire according to claim 1, wherein the resilient element is coupled to the first end cap and to the complementary connector part, and wherein the complementary connector part is arranged translationally movable relative to the first end cap.

3. A luminaire comprising a hollow light transmissive body, an LED assembly comprised by the hollow light transmissive body, and a first end cap closing the hollow light transmissive body at a first end of the hollow light transmissive body and functionally coupled to the hollow light transmissive body; wherein the LED assembly is functionally coupled to a connector part;

the first end cap is functionally coupled to a complementary connector part, complementary to the connector part; and the LED assembly and the first end cap are associated with each other through the connector parts, while allowing a translational movement of the LED assembly along a longitudinal axis relative to the hollow light transmissive body, wherein the luminaire comprises a resilient element arranged for forcing the LED assembly and the first end cap in a direction to each other, and wherein the resilient element is coupled to the LED assembly and to the connector part, and wherein the connector part is arranged translationally movable relative to the LED assembly;

wherein the LED assembly comprises a support for a plurality of LEDs and a mounting clip, wherein the mounting clip is functionally coupled to the connector part, wherein the mounting clip further comprises a clip connector element, and wherein the support comprises a complementary clip connector element, complementary to the clip connector element, wherein the mounting clip and the support are connected to each other through the clip connector elements.

4. The luminaire according to claim 3, wherein the mounting clip is detachably connected to both the LED assembly and the first end cap.

5. The luminaire according to claim 3, wherein the clip connector elements provide an interference fit between the mounting clip and the support.

6. The luminaire according to claim 3, wherein the complementary clip connector element comprises an opening, and wherein the clip connector element comprises a protrusion configured for arranging in the opening.

7. The luminaire according to claim 3, wherein the mounting clip comprises a clip base part and a second clip part extending from the base part, wherein the base part comprises the clip connector element and the second clip part comprises a top protrusion, wherein the mounting clip is configured for holding the support between the clip base part and the top protrusion.

8. The luminaire according to claim 3, wherein the support comprises a printed circuit board comprising the LEDs.

9. The luminaire according to claim 1, wherein the luminaire is a luminaire according to the International Protection Marking IP65.

10. An LED assembly functionally coupled to a connector part, wherein the connector part is configured to connect to a complementary connector part;

the LED assembly further comprises a resilient element, wherein the resilient element is coupled to the LED assembly and to the connector part and wherein the resilient element is configured to exert a permanent force in an axial direction along a longitudinal axis when the connector part is connected to the complementary connector part; and the connector part is arranged translationally movable relative to the LED assembly for allowing a translational movement of the LED assembly along the longitudinal axis and for functionally coupling the LED assembly and the connector part;

wherein the LED assembly comprises a support for a plurality of LEDs and a mounting clip, wherein the mounting clip is functionally coupled to the connector part, wherein the mounting clip further comprises a clip connector element, and wherein the support comprises a complementary clip connector element, complementary to the clip connector element, wherein the mounting clip and the support are connected to each other through the clip connector elements.

11. A mounting clip for coupling to a support of an LED assembly, wherein the mounting clip comprises a clip connector element configured for connecting the mounting clip and the support to each other through the clip connector element;

the mounting clip comprises a resilient element and a connector part, wherein the mounting clip is functionally coupled to the connector part and, wherein the resilient element is coupled to the mounting clip and to the connector part, and wherein the resilient element is configured to exert a permanent force in an axial direction along a longitudinal axis when the connector part is connected to a complementary connector part, and wherein the connector part is arranged translationally movable relative to the mounting clip;

wherein the resilient element comprises a spring element, wherein the connector part comprises a screw thread, wherein the complementary connector part comprises a complementary screw thread, complementary to the screw thread of the connector part, wherein an axis of the screw thread is configured parallel to the longitudinal axis, and wherein the translational movement of the LED assembly along the longitudinal axis relative to the hollow light transmissive body is based on a difference in thermal expansion between the LED assembly and the hollow light transmissive body.

12. A method of assembling a luminaire as claimed in claim 1, the method comprising:

providing (i) a hollow light transmissive body having an open first end, (ii) an LED assembly comprising a first end, wherein the first end is functional coupled to a connector part on a mounting clip, and (iii) a first end cap, wherein the first end cap comprises a complementary connector part, configured complementary to the connector part, wherein the LED assembly is comprised by the hollow light transmissive body;

closing and functionally coupling the hollow light transmissive body at the first end with the first end cap, through the respective connector parts; and activating the functionally coupling by building up a permanent tensile force in an axial direction along a longitudinal axis of a resilient element coupled to the mounting clip and to the connector part.

* * * * *